US010611017B1

(12) United States Patent
Panosian et al.

(10) Patent No.: US 10,611,017 B1
(45) Date of Patent: Apr. 7, 2020

(54) STORAGE BAG WITH ENHANCED INTERIOR VISIBILITY

(71) Applicant: TOUGHBUILT INDUSTRIES, INC., Lake Forest, CA (US)

(72) Inventors: Michael H. Panosian, Irvine, CA (US); Joshua Keeler, Lake Forest, CA (US)

(73) Assignee: TOUGHBUILT INDUSTRIES, INC., Lake Forest, CA (US)

( * ) Notice: Subject to any disclaimer, the term of this patent is extended or adjusted under 35 U.S.C. 154(b) by 0 days.

(21) Appl. No.: 16/669,056

(22) Filed: Oct. 30, 2019

Related U.S. Application Data

(60) Provisional application No. 62/890,420, filed on Aug. 22, 2019.

(51) Int. Cl.

| | |
|---|---|
| ***A45C 5/06*** | (2006.01) |
| ***B25H 3/00*** | (2006.01) |
| ***A45C 13/10*** | (2006.01) |
| ***A45C 13/02*** | (2006.01) |

(52) U.S. Cl.
CPC ..... *B25H 3/00* (2013.01); *A45C 5/06* (2013.01); *A45C 13/02* (2013.01); *A45C 13/103* (2013.01)

(58) Field of Classification Search
CPC ..... A45C 13/00; A45C 5/06; A45C 13/103; A45C 13/02; B25H 3/00
USPC ..... 190/107, 903, 106; 206/372; 150/114; 383/98
See application file for complete search history.

(56) References Cited

U.S. PATENT DOCUMENTS

| | | | | |
|---|---|---|---|---|
| 852,729 | A * | 5/1907 | Limbacher | 190/107 |
| 1,834,740 | A * | 12/1931 | Rhett | A45C 7/0059 190/107 |
| 4,258,538 | A * | 3/1981 | Morse | A01D 43/063 383/120 |
| 4,561,525 | A * | 12/1985 | Shidner | A45C 3/00 190/106 |
| 4,802,233 | A * | 1/1989 | Skamser | A47J 47/145 206/545 |
| 4,929,094 | A * | 5/1990 | Becker | A45C 3/00 383/110 |
| 4,976,352 | A | 12/1990 | Nordstrom | |
| 6,550,592 | B1 * | 4/2003 | Godshaw | A01K 1/0254 190/107 |
| 6,936,791 | B1 * | 8/2005 | Baldwin | A47J 36/2483 219/387 |

(Continued)

*Primary Examiner* — Sue A Weaver
(74) *Attorney, Agent, or Firm* — Myron Greenspan; Lackenbach Siegel LLP

(57) ABSTRACT

A storage bag has rear wall is spaced from a front wall a distance D and an upper opening. A lid includes front and rear lid portions movably joined to upper ends of the front and rear walls. The front lid portion has a height A when upright and the rear lid portion has a height B when upright, wherein A<D/2, B>D/2 and A+B≈D to define a side inclined relative to the bottom wall between the upper edges of the lid portions in their open positions. The inclined side has a length C wherein $C^2=(B-A)^2+D^2$. A flexible web is co-planar with each of the side walls in the open positions of the lid portions. Each web is joined to the front and rear lid portions and an associated side wall and extends along an associated inclined side. A zipper extends along the edges of the front and rear lid portions and along an associated inclined side of each web.

5 Claims, 4 Drawing Sheets

(56) References Cited

U.S. PATENT DOCUMENTS

| | | | | |
|---|---|---|---|---|
| 7,604,103 | B2 * | 10/2009 | Hamlin | A45C 7/0022<br>150/112 |
| 8,302,749 | B2 * | 11/2012 | Melmon | A45F 3/04<br>150/103 |
| 8,695,793 | B2 * | 4/2014 | Saggar | B65D 33/007<br>206/233 |
| 2002/0064323 | A1 * | 5/2002 | Chin | A45C 13/103<br>383/97 |
| 2009/0145711 | A1 * | 6/2009 | Panosian | A45C 7/0086<br>190/107 |

* cited by examiner

STORAGE BAG WITH ENHANCED INTERIOR VISIBILITY

BACKGROUND OF THE INVENTION

1. Field of the Invention

The invention generally relates to storage bags and, more specifically, to a storage bag useful for storing hand tools, associated hardware and supplies for workers as well as other items by consumers and facilitating organization and visibility of stored items.

2. Description of the Prior Art

Storage bags are typically rectangular with varying dimensions to accommodate different applications and uses. Usually such storage bags are opened at the top to maximize the internal volume of the items to be carried. The bags normally have a single top panel, foldable or pivotable about one edge, or two panels that are hinged or pivoted at opposing edges. An example of a soft storage bag of this type is described in Publication No. 2009/0145711 when such bags are opened the front, rear and side walls all have the same heights and create a square profile so that a user is motivated to look straight down into the rectangular opening.

In U.S. Pat. No. 4,976,352 a camera bag is designed to be opened and carried by a user to facilitate manual access to the main packing compartment as well as to a lid pocket. This also makes it convenient when the bag is carried by the carry strap to operate the zipper slides. The bag is not designed to enhance the viewability of the contents from the front of the bag, or to promote additional features and functionalities to the inside surface of the rear wall. The front and rear walls remain fixed both in the open and closed positions of the bag. The lid pocket becomes the closure, top wall or lid of the bag.

SUMMARY OF THE INVENTION

Accordingly, an object of the invention to provide a storage bag that disadvantages of prior art or known storage bags.

It is another object of the invention to provide a storage bag that is simple in construction and economical to manufacture.

It is still another object of the invention to provide a storage bag that has enhanced interior visibility of the bag when an upper lid is opened.

It is yet another object of the invention to provide a storage bag as described above that provides a surface area on the inside surface of an opened lid facing a user to accommodate pockets or compartments or other storage or securing devices.

In order to achieve the above and other objects that will become evident hereinafter, a storage bag has a generally rectangular bottom wall; a front wall; spaced substantially parallel side walls; a rear wall spaced from said front wall a distance "D", said front wall, side walls and rear wall having substantially equal heights and together defining an upper opening. A lid is provided for exposing said upper opening when moved to an open position and closing said upper opening when moved to a closed position. Said lid comprises front and rear lid portions movably joined to upper ends of respective ones of said front and rear walls. Said front lid portion has an upper edge and a height "A" when upright and generally coextensive with said front wall and said rear lid portion has an upper edge and a height "B" when upright and generally coextensive with said rear wall, wherein $A<D/2$, $B>D/2$ and $A+B\approx D$ to define a side inclined relative to said bottom wall between said upper edges of said lid portions in their open positions, said inclined side having a length C wherein $C^2=(B-A)^2+D^2$. A flexible web is portions, each web being joined to said front and rear lid portions and an associated side wall and extending along an associated inclined side; and a closure device extending along said edges of said front and rear lid portions, an associated side wall and along and an associated inclined side of each web, whereby closure of said lid portions causes said webs to fold on the outside of the storage bag on the exteriors of said side walls and opening of said lid provides enhanced visibility of the interior of the bag.

BRIEF DESCRIPTION OF THE DRAWINGS

The above and other aspects, features and advantages of the present invention will be more apparent from the following description when taken in conjunction with the accompanying drawings, in which.

DESCRIPTION OF PREFERRED EMBODIMENTS

Figure 1:
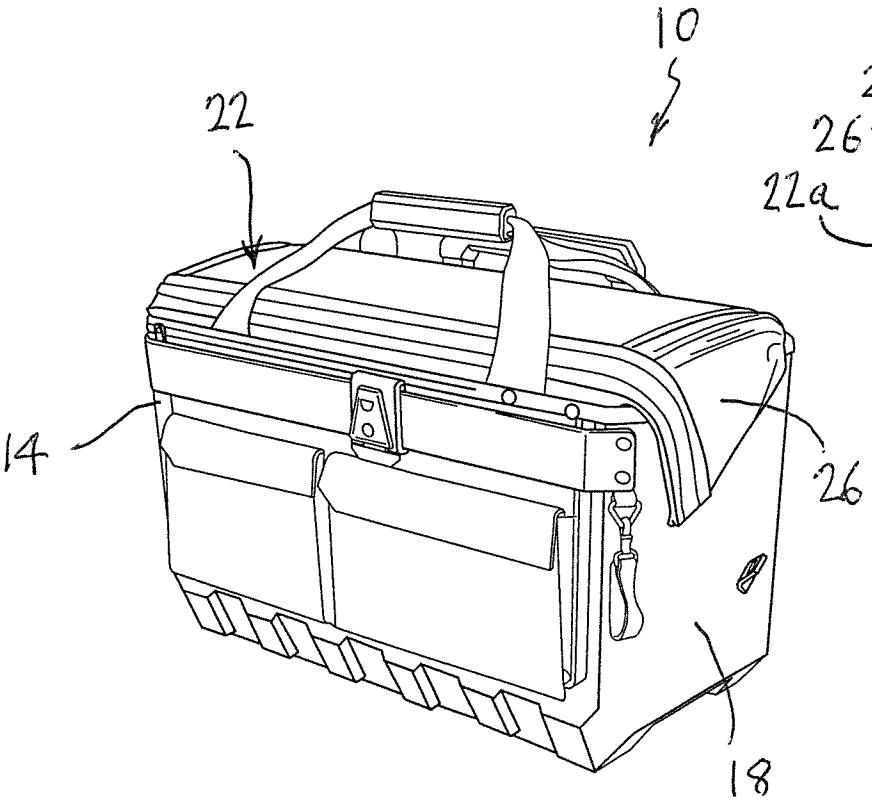
FIG. 1 is a perspective view of a storage bag in accordance with the present invention, shown in the closed lid condition.

Referring now specifically to the figures, in which the identical or similar parts are designated by the same reference numerals throughout, and first referring to FIG. 1, a storage bag or case in accordance with the invention is generally designated by the reference numeral 10.

Referring to FIGS. 1-4, the bag 10 has a generally rectangular bottom wall 12, a front wall 14, a rear wall 16 and spaced substantially parallel side walls 18. The rear wall 16 and the front wall 14 are spaced a distance "D". The front wall, side walls and rear walls have a substantially equal heights and together define an upper opening 20.

Figure 2:
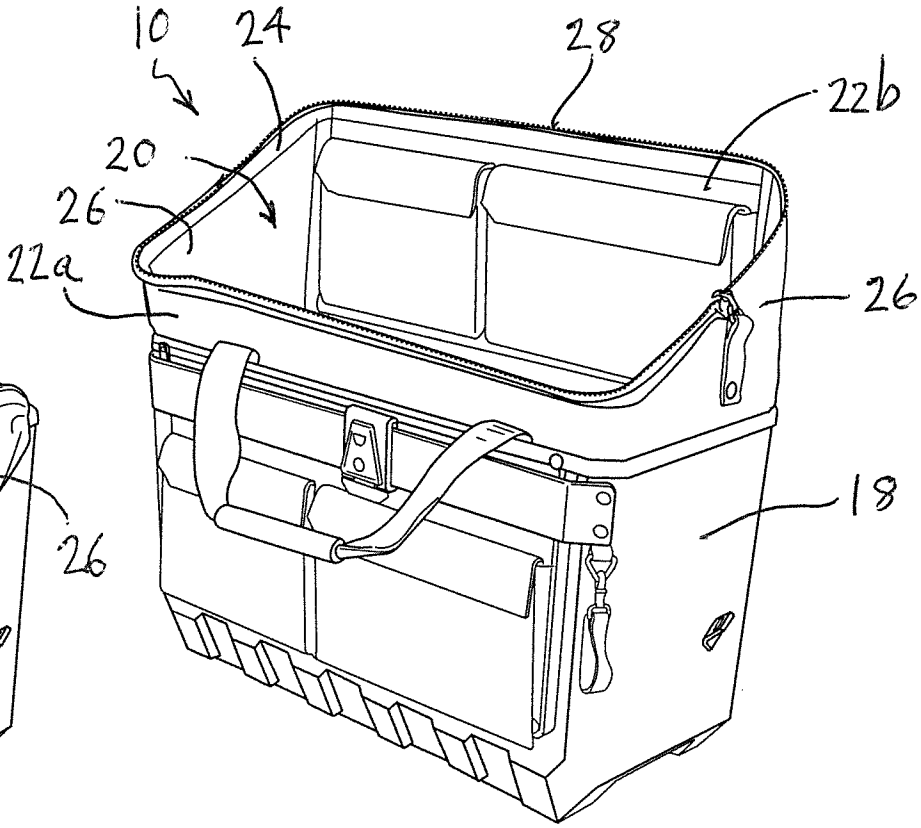
FIG. 2 is similar to FIG. 1 but shows the bag in the open lid condition.
Figure 4:
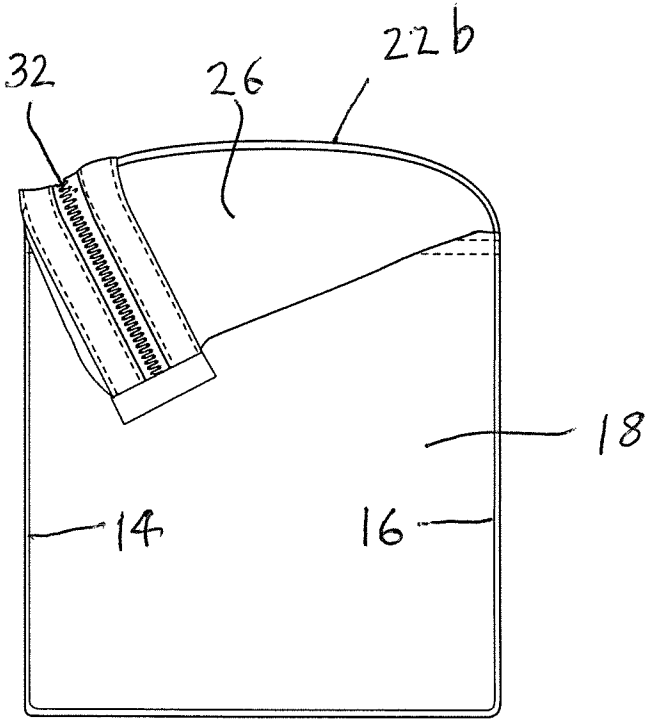
FIG. 4 is a side elevational view of the bag in the closed lid condition.
Figure 3:
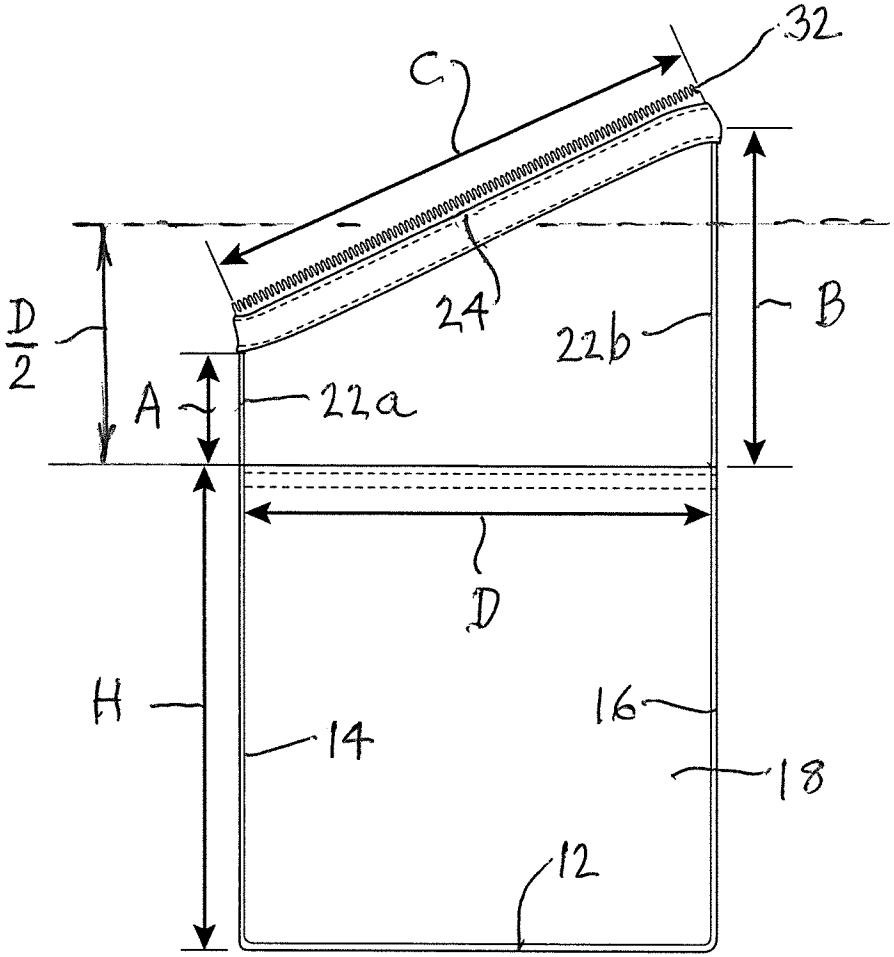
FIG. 3 is a diagrammatic side elevational view of the bag shown in FIGS. 1 and 2, in the open lid condition.

A lid 22 provides access to the bag 10 through the upper opening 20 when moved to an open position as shown in FIGS. 2 and 3 and closes the upper opening when moved to a closed position as shown in FIGS. 1 and 4. The lid 22 includes a front lid portion **22*a* and a rear lid portion 22*b* that are movably joined to the upper ends of the front and rear walls 14, 16**, respectively.

Referring specifically to FIG. 3, the front lid portion **22*a* has an upper edge as shown and a height "A" when upright and generally co-extensive with the front wall 14. The rear lid portion 22*b* has an upper edge as shown and a height "B" when upright and generally coextensive with the rear wall 16. An important feature of the invention is that A<D/2, B>D/2 and A+B≈D to define a side 24 inclined between the upper edges of the lid portions 22***a*, 22*b* in their open positions. The inclined sides above each side wall 18 has a length "C" wherein $C^2=(B-A)^2+D^2$. This is distinguished from prior art bags wherein A is typically equal to B. As will be noted from FIG. 3, therefore, the height D/2, being one half of the depth D of the bag, always exceeds dimension A and is always less than the dimension B.

Referring to FIGS. 2 and 3, a web 26 is provided above each of the side walls 18, each web being generally co-planar with each of the side walls in the open positions of the lid portions 22*a*, 22*b*. Each web 26 is joined to the front and rear lid portions, an associated side wall and extends up to and along an associated inclined side 24. A suitable closure device is provided that extends along the edges of the front and rear lid portions 22*a*, 22*b* and along an associated inclined side 24 of each web.

When the lid is in the open position or condition the lids expose the interior of the bag and provides enhanced visibility of the interior of the bag. When the lid portions are closed the webs 26 fold on the outside of the storage bag as shown, for example, in FIGS. 1 and 4. The webs are made of a flexible material so that they can be readily folded when the lid portions 22*a*, 22*b* are closed.

Any closure device may be used to retain the lid portions in their closed condition. In the illustrated embodiment the closure device is a substantially continuous zipper 28 that extends along the edges of the front and rear lid portions, and associated inclined sides of each web. When the bag 10 is closed the flexible webs 26 fold about lines and are positioned outside of the bag proximate to the exterior surface of each of the side walls 18 as shown in FIGS. 1 and 4.

As illustrated in FIG. 2, when the lid portions are opened and in their upright or open condition(s), the rear lid portion 22*b* exhibits an inside surface S that is greater than the surface exhibited by the front lid portion 22*a*. The surface area S is greater than available with other known bags where the front and rear portions 22*a*, 22*b* have the same dimensions. It will be appreciated that the smaller the dimension "A" and the greater the dimension "B" the greater will be the inside surface area S. The surface S can be used for a host of purposes including supporting pouches 34, for storing small tools, hardware and other small parts and can also be used to support small tools by means of elastic straps, clips or clamps 36.

Referring to FIGS. 5-8, a presently preferred embodiment is illustrated wherein A is substantially equal to 0 and B is substantially equal to "D". In this design, the webs 26 define, in the open position of the bag, substantially a right isosceles triangle in which the inclined side 24 is inclined approximately 45° in relation to the bottom wall 12.

When the bag is used in conjunction with rolling wheels (not shown) telescoping rods or tubes 38 connected to a handle (not shown) retainers 40 (FIG. 7) can be used to secure the movable lid portion 22*b* in the open condition as shown in FIGS. 2 and 3. The specific retainers used is not critical, and magnets that magnetically register with the tubes or rods 38, clips that snap onto the tubes or the like. When the bag is made from a textile material that is sufficiently stiff the rear lid portion 22*b* may be sufficiently stiff to retain the lid portion in an upright position without any additional support mechanism while still allowing it to be physically pivoted, folded or moved relative to the rear wall 16.

Figure 5:
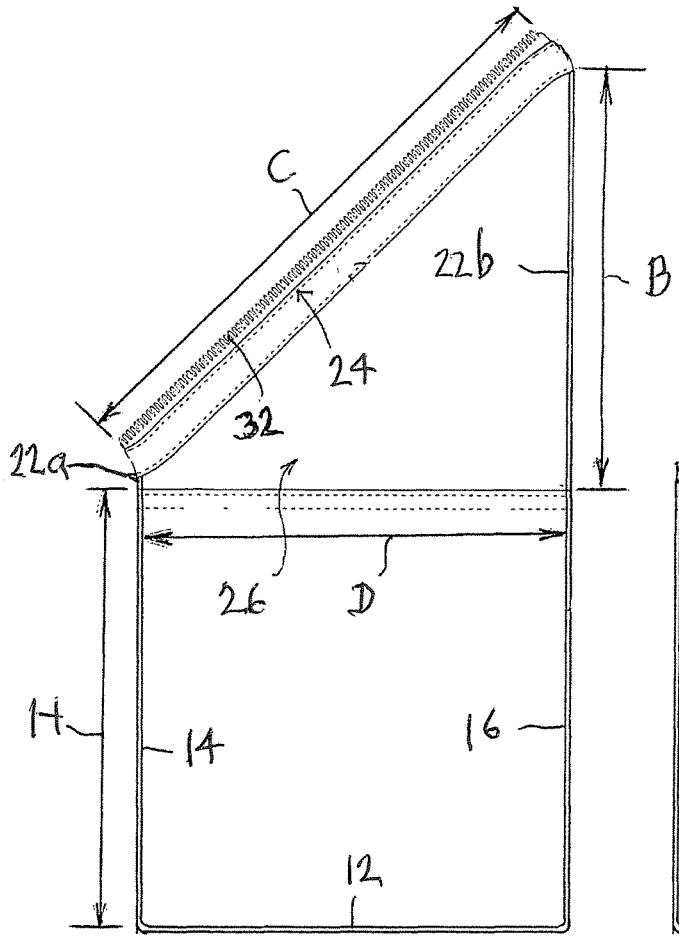
FIG. 5 is similar to FIG. 3 showing different parameters for dimensions A and B.
Figure 6:
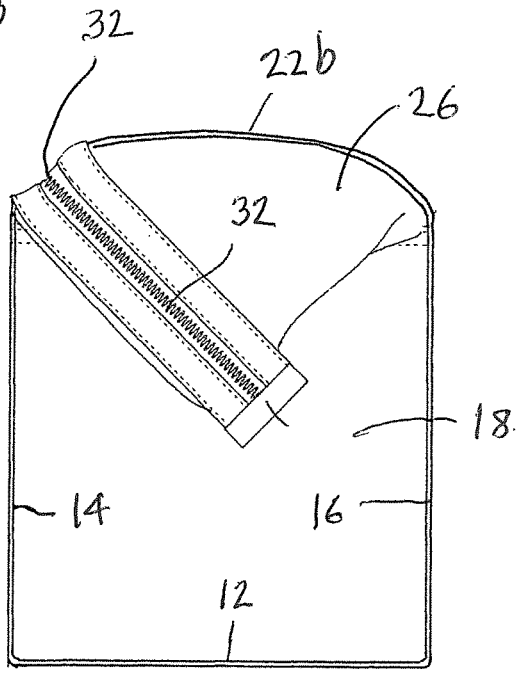
FIG. 6 is similar to FIG. 4 for the bag shown in FIG. 5.
Figure 7:
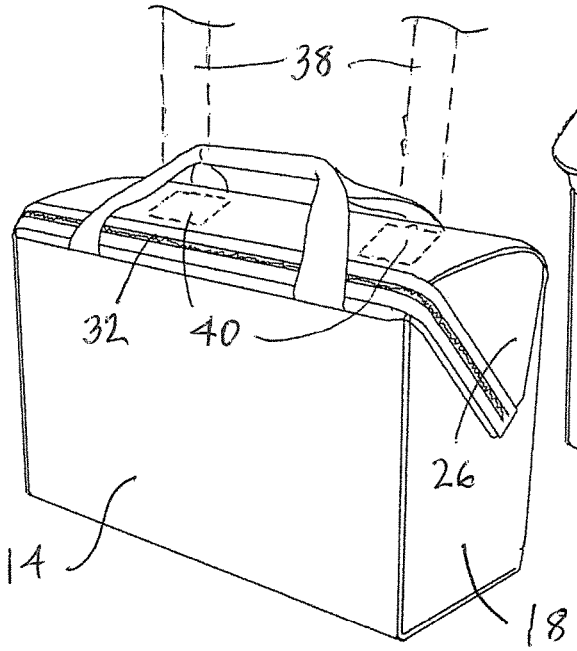
FIG. 7 is a perspective view of the storage bag shown in FIG. 1 wherein the bag is a rolling bag.
Figure 8:
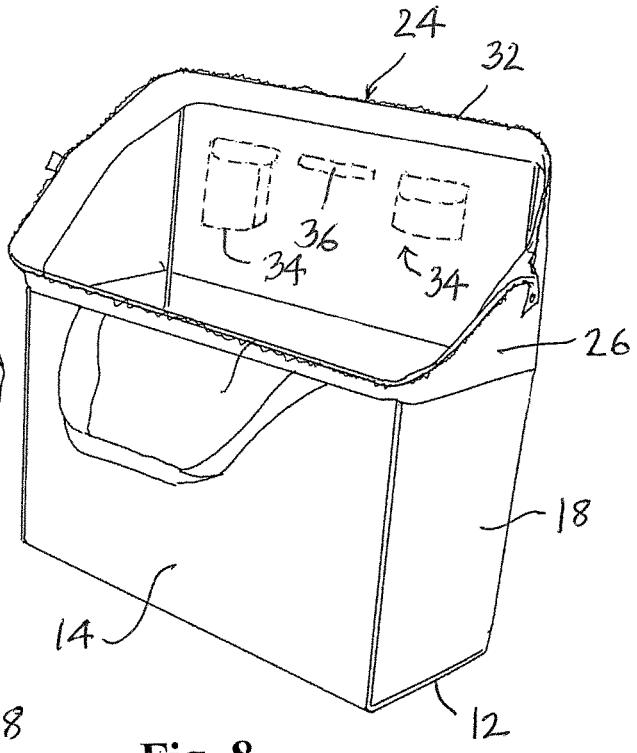
FIG. 8 is similar to FIG. 2 showing some additional support features on the inside surface of the rear lid portion when in the open condition.

A 45 degree bag shown in FIGS. 5 and 6 provides an optimum height differential between the rear wall portion and the front wall portion to make it easier to see into the open bag, and create a maximum vertical surface S at the interior of the rear wall portion for additional features, as indicated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A storage bag having a generally rectangular bottom wall; a front wall; spaced substantially parallel side walls; a rear wall spaced from said front wall a distance D, said front wall, side walls and rear wall having substantially equal heights and together defining an upper opening; a lid for exposing said upper opening when moved to an open position and closing said upper opening when moved to a closed position, said lid comprising front and rear lid portions movably joined to upper ends of respective ones of said front and rear walls, said front lid portion having an upper edge and a height A when upright and generally coextensive with said front wall and said rear lid portion having an upper edge and a height B when upright and generally coextensive with said rear wall, wherein A<D/2, B>D/2 and A+B≈D to define a side inclined relative to said bottom wall between said upper edges of said lid portions in their open positions, said inclined side having a length C wherein $C^2=(B-A)^2+D^2$; a flexible web generally co-planar with each of said side walls in said open positions of said lid portions, each web being joined to said front and rear lid portions and an associated side wall and extending along an associated inclined side; and a closure device extending along said edges of said front and rear lid portions and along an associated inclined side of each web, whereby closure of said lid portions causes said webs to fold on the outside of the storage bag on the exteriors of said side walls and opening of said lid provides enhanced visibility of the interior of the bag.

2. A storage bag as defined in claim 1, wherein A≈0.

3. A storage bag as defined in claim 1, wherein said closure device comprises a zipper.

4. A storage bag as defined in claim 1, wherein said rear lid portion has an inner surface facing said front wall when in an open position, and further comprising storage means on said inner surface.

5. A storage bag as defined in claim 4, wherein said storage means comprises at least one pocket or pouch for storing items therein and securing or holding devices.

* * * * *